US005595648A

United States Patent [19]

Yan

[11] Patent Number: 5,595,648

[45] Date of Patent: Jan. 21, 1997

[54] TWO PHASE REMOVAL OF HALIDES FROM LIQUID HYDROCARBONS CROSS-REFERENCE TO RELATED APPLICATIONS

[75] Inventor: Tsoung Y. Yan, Wayne, Pa.

[73] Assignee: Mobil Oil Corporation, Fairfax, Va.

[21] Appl. No.: 367,501

[22] Filed: Dec. 30, 1994

[51] Int. Cl.[6] ..... C10G 19/00; C10G 19/073; C10G 29/12

[52] U.S. Cl. ..... 208/308; 208/262.1; 208/283; 208/286; 208/287; 208/203; 208/284; 95/233; 95/237

[58] Field of Search ..... 208/262.1, 283, 208/286, 287, 203, 308, 284; 95/233, 237

[56] References Cited

U.S. PATENT DOCUMENTS

| | | | |
|---|---|---|---|
| 1,833,396 | 11/1931 | Gary | 208/286 |
| 2,481,300 | 9/1949 | Engel | 196/36 |
| 2,951,804 | 9/1960 | Juliard | 208/91 |
| 3,378,485 | 4/1968 | Rampino | 208/188 |
| 3,403,198 | 9/1968 | Van Pool | 208/262.1 |
| 3,445,381 | 5/1969 | Urban | 208/286 |
| 3,761,534 | 9/1973 | Sun et al. | 260/674 |
| 3,898,153 | 8/1975 | Louder et al. | 208/89 |
| 4,123,351 | 10/1978 | Chapman et al. | 208/262.1 |
| 5,314,614 | 5/1994 | Moser et al. | 208/262.1 |

FOREIGN PATENT DOCUMENTS

| | | | |
|---|---|---|---|
| 525153 | 7/1956 | Canada | 208/286 |

OTHER PUBLICATIONS

Copies of portions of "Opposers" work.

*Primary Examiner*—Anthony McFarlane
*Assistant Examiner*—Patricia L. Hailey
*Attorney, Agent, or Firm*—Malcolm D. Keen

[57] ABSTRACT

Acidic halides, especially chlorides, are removed from dry liquid hydrocarbon streams such as catalytic reformate by contact with large particles of low surface area solid caustic such as a bed of NaOH pellets. Effective neutralization is achieved in a bed which is essentially free of any aqueous phase. Salt formed by the neutralization reaction deposit as solids on the surface of the solid caustic. A process for producing a low chloride, dry reformate product is also disclosed.

18 Claims, 1 Drawing Sheet

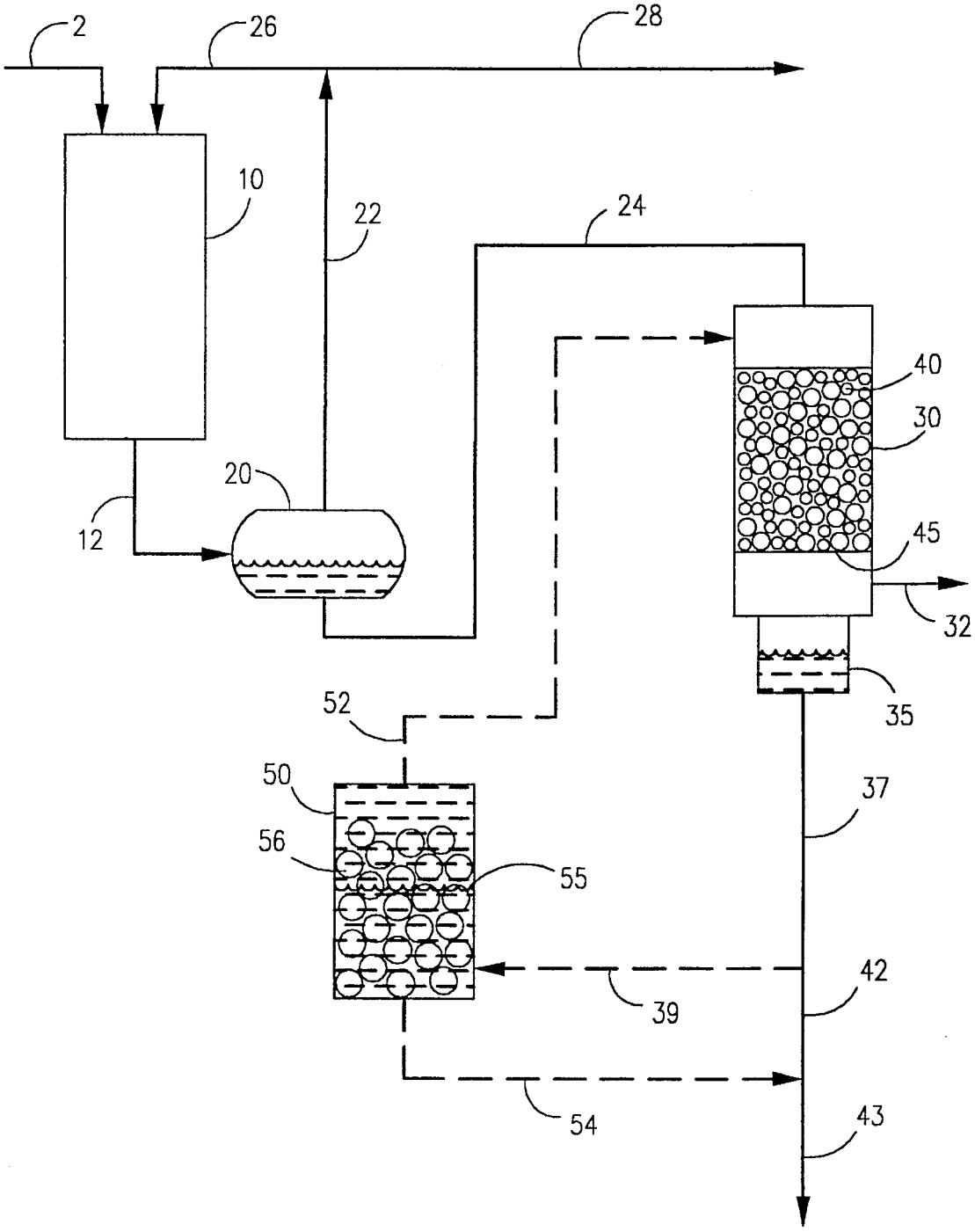
2
26
28
10
22
24
40
30
20
12
45
32
35
52
50
37
56
55
42
39
54
43

TWO PHASE REMOVAL OF HALIDES FROM LIQUID HYDROCARBONS CROSS-REFERENCE TO RELATED APPLICATIONS

CROSS-REFERENCE TO RELATED APPLICATIONS

This application is related to my prior co-pending application Ser. No. 08/217821 filed on Mar. 25, 1994.

This application is also related to other applications of mine filed simultaneously with this application directed to:

| DOCKET | TITLE |
|---|---|
| 7579 | TWO PHASE TREATMENT OF VAPOR TO REMOVE HALOGENS |
| 7580 | QUADRI PHASE TREATMENT OF VAPOR TO REMOVE HALOGENS |
| 7581 | TWO PHASE REMOVAL OF HALOGENS FROM LIQUID HYDROCARBONS |
| 7582 | THREE PHASE REMOVAL OF HALOGENS FROM LIQUID HYDROCARBONS |
| 7583 | REMOVAL OF ACIDIC HALOGENS FROM HOT GAS STREAMS AND ATTRITION REGENERATION OF CAUSTIC |
| 7584 | WASHING SALT FROM SOLID CAUSTIC WITH OIL |
| 7585 | NEUTRALIZING VAPOR/LIQUID SEPARATOR |

FIELD OF THE INVENTION

This invention relates to removal of halogens, especially chlorides, from relatively dry liquid hydrocarbon streams such as reformate.

BACKGROUND OF THE INVENTION

Catalytic reforming, using Pt based reforming catalyst, is one of the most important refinery processes in the world. Most refineries have a catalytic reformer, which converts naphtha fractions into high octane reformate.

Reformers come in many types and sizes—from 2000 BPD fixed bed units to moving or swing bed units processing more than 50,000 BPD. Reformers are available with fixed bed reactors, swing bed reactors, or moving bed reactors. Many new units are moving bed reactors, available from UOP, Inc, Des Plaines, Ill.

Reformers generally use mono-metallic catalysts (Pt on a support such as alumina) or hi-metallic catalyst (Pt-Re on a support). Other combinations of Pt and other metals are known. All reforming catalyst are believed to contain a halogen, almost invariably chlorine. The presence of chlorine is beneficial for the reforming process, and may be essential for successful regeneration of Pt catalyst, as the Cl helps keep the Pt dispersed as small crystals on the catalyst.

While all reformers are believed to have some chloride compounds in the reformate, the problem is most serious when a continuous reformer is used, and especially so when the catalyst is near the end of its useful life.

Some refiners add chlorine compounds continuously to their units to maintain a high chloride level on the catalyst. In continuous or moving bed reformers the catalyst is chlorided after coke burn but before return to the top of the reforming reactor. More chlorine is added now, as opposed to 10 or 20 years ago, both as a prophylactic measure to allow the units to be pushed harder, and the belief that catalyst regeneration is more successful with more Cl on catalyst.

Cl in the reformate causes problems in downstream units. The main chloride compounds in reformate are believed to be HCl, $NH_4Cl$ and $FeCl_3$. Some refiners may use other halogens, such as Fl or I, but Cl is the halogen of choice, so hereafter chlorine and its reaction or degradation products will be referred to rather than halogens in general.

Chlorine compounds in reformate cause several problems. Some regions have a pH specification on gasoline, which can not be met if large amounts of HCl are present in the reformate. Chlorides can seriously affect downstream processing units, such as a Sulfolane aromatics extraction unit, if the reformate is so treated.

Chlorides can cause very immediate problems in the reformer. If the reformer is relatively dry, as most are, the chlorides form salts which plug up the reformer fractionators. If water is added to wash the salts out then HCl is formed, which causes serious corrosion problems. As an example, one of our refineries had a problem with chloride salt buildup in product fractionators. Every three months or so the fractionator efficiency declined so that it was necessary to water wash the column. About 1 wt % water was added to the tower to wash out salts. This cleaned the column, but would also form some HCl, which can attack some steels, especially with water present.

The problem has gotten worse in the last decade, going from nuisance to major problem. The conventional methods of handling chloride in reformate will be briefly reviewed. These are grouped arbitrarily below and reviewed in detail hereafter.

1. Water washing,
2. Solid adsorbent treating of reformate,
3. Chemical treatments.

1. Water Washing

Water washing of a depropanizer fractionating tower that was part of a continuous catalytic reformer was reported in Example 2 of U.S. Pat. No. 4,880,568. Periodic water washing for a severe fouling and corrosion problems was not effective, "an elaborate continuous water wash system was installed. The continuous water wash system also failed to solve the deposit problem." Such a system also introduces water into the process which water will cause additional problems.

Example 2 of '568 was directed to continuous or intermittent treatment of a chloride containing fraction of a reformate.

Somewhat related is an aqueous, alkaline treatment of the reformate liquid upstream of the debutanizer. We tried a brief test in one of our commercial refineries at solving a chloride problem by injecting dilute caustic into reformate intermediate the V/L separator and the debutanizer. The caustic was less than 15°or 20° C. A mesh pad was used to aid in separation of caustic/reformate in a separator vessel. The experiment was not considered a success. A flow control valve corroded, and the experiment was stopped.

Probably the contact between caustic and reformate was poor. The addition of water would have also caused problems.

2. Solid Adsorbent Treating

Some refiners use beds of solid adsorbent material to prevent chloride corrosion and fouling. More details about this type of treatment are available from UOP Inc which has endorsed use of at least one type of solid adsorbent to remove chlorides from reformate.

Such solid adsorbent beds can plug, and many refiners do not want to use that approach. Such adsorbents are also believed to be expensive, typically involving proprietary adsorbents. At least some of these proprietary materials are thought to be ineffective for removing $NH_4Cl$.

Somewhat related to the above solid bed treatment of reformate streams is the use of a somewhat porous, relatively densely poured bed of granular alkalies to treat a variety of hydrocarbon streams in Sun, U.S. Pat. No. 3,761,534, which is incorporated by reference.

Example 1 used 4–8 mesh granular NaOH to remove sulfuric acid from an alkylate stream of tert.—butylated ethyl-benzene containing about 0.3N total acid, primarily sulfuric acid. Although efficient acid removal first occurred, the bed plugged before 100 volumes of alkylate could flow through the bed.

Example 4 used no NaOH, but treated an effluent from the alkylation of benzene with ethylene in the presence of HCl with soda lime and glassmaker's (G. M.) alkali to remove acid. Example 5 used pellets of C. P. NaOH to treat crude tert. butylated ethyl-benzene containing 570 ppm $H_2SO_4$. NaOH pellets plugged at 92 weights of alkylate per weight of alkali, while beds of soda lime and G. M. alkali did not plug.

Example 7 used G. M. alkali on a support grid to treat crude tert.butylated ethylbenzene containing about 600 ppm sulfuric acid. The organic flowed up through the support grid, through the alkali to an outlet above the bed of alkali. A white precipitate built up in the reservoir below the grid, which was periodically removed through a drain valve by a water purge. The bed of alkali was reported essentially unchanged by casual observation and there was no increase in resistance to flow through it.

The streams treated in '534 were probably saturated with water, and/or carried entrained water, as periodic water purges were reported in many examples. Some of the results reported could be summarized as follows:

Beds of caustic pellets do not work for very long to remove acidic contaminants from such liquid hydrocarbon streams.

All beds plug in downflow operation or rapidly lost effectiveness. Upflow operation with alkali on a support of a grid or coarse screen works a long time because salts that form can fall down through the screen.

Porous G. M. alkali was better than solid caustic.

3. Chemical Treatments

Several patents are directed at adding treatment chemicals which inhibit the formation of ammonium chloride in units, and are believed directed at keeping chloride compounds in a form which will not precipitate as a solid in process equipment. Some treatment programs include chelating agents and/or film forming agents to prevent further corrosion.

U.S. Pat. Nos. 5,282,956 and 5,256,276, which are incorporated by reference, disclose inhibiting ammonium chloride deposition by adding an amide such as 1,3-dimethyl-2-thiourea or phosphatide such as lecithin.

U.S. Pat. No. 2-thiourea 4,880,568, METHOD AND COMPOSITION FOR THE REMOVAL OF AMMONIUM SALT AND METAL COMPOUND DEPOSITS, Staley et al, Assignee Aqua Process, Inc., Houston, Tex. discloses injecting amines and chelating agents into reformate to remove and/or prevent formation of ammonium salt deposits. Amines added form amine salts with a low melting point or an affinity for trace amounts of water. This patent is incorporated by reference.

While adding chemicals to prevent formation of ammonium chloride deposits and/or chelating agents to remove metal corrosion products will help, such approaches are expensive and are not considered the ideal solution. Film forming agents may still be needed to protect metal surfaces in process equipment. Additives added will end up in one or more product streams, and these additives may cause additional problems downstream.

Many refiners would prefer to eliminate the problem, if possible, rather than add more chemicals to their reformate which must be dealt with in downstream processing units.

I studied the problem of chloride removal from reformate, and found nothing that was completely satisfactory.

The conventional approaches had several shortcomings. Unconstrained contact of reformate with dilute caustic was not successful in our refinery test. Continuous water washing was not successful in a depropanizer, as reported in U.S. Pat. No. 4,880,568.

I had concerns about adding more water to refinery streams. Catalytic reformate is a dry stream, passing through multiple distillation columns prior to reforming. Adding water to such a heretofore dry stream may (and has) cause corrosion or other problems in downstream units.

One of our refineries tried a proprietary method of dealing with chloride in reformate involving addition of chemicals, but the cure was worse than the disease.

I wanted to remove chlorides entirely from the reformate, not merely convert them to less noxious materials. I wanted to remove them, but without adding other chemicals to the reformate stream, and especially without adding a lot of water to the reformate.

I was concerned that solid adsorbent beds were likely to plug and difficult to regenerate. I knew that a liquid based system could be made to work, as disclosed in my earlier application, Ser. No. 08/217,821 filed on Mar. 25, 1994. There I disclosed a way to remove essentially all of the Cl from typical reformate streams using a water based reactive extraction process. While that process is a significant advance over the state of the art, it did have some disadvantages, which are reviewed below.

My earlier process used an aqueous solution to treat the reformate. This always added a minor amount of water to the reformate stream. Although the amount added could be much less than equilibrium, some refiners wish to keep their reformate streams as dry as possible. This meant that a liquid solution had to be prepared and perhaps stored. Some refiners were concerned that some of this aqueous solution might be entrained in the reformate. The process also produced a relatively dilute brine byproduct as a result of removing halogen from the liquid reformate stream.

I have now discovered a better way to remove halogens from reformate and similar naphtha hydrocarbon streams which does not require any aqueous reagents. I found that solid caustic can efficiently remove halogens from reformate in a completely dry system.

One key to making the process work was selecting a stream which was relatively dry for treating, or rather in applying this process only to selected streams which were not saturated with water. If this process is tried on water saturated streams, the solid caustic bed will soon plug, and the desired form of salt precipitation, discussed below, will not occur.

By treating dry streams, with non-porous solid caustics in a bed with a large interstitial volume, most of the salt that forms from the neutralization reaction can be deposited on the surface of the solid caustic. This salt can be safely held on the surface of the solid caustic as a relatively soft fluffy deposit. It looked much like rust on an iron plate. This salt could be held by the caustic and fill up interstitial places in the caustic bed, without plugging the bed.

Significant run lengths can be achieved when treating liquid hydrocarbon streams not saturated with water with a dry, solid caustic bed. This makes the process a worthy substitute for alumina treaters even without regeneration of the caustic. I also developed a caustic bed regeneration procedure, which can selectively dissolve such salt deposits, in preference to caustic, which multiplies the cost effectiveness of solid bed treating.

BRIEF SUMMARY OF THE INVENTION

Accordingly, the present invention provides a process for a process for removing acidic halides from dry liquid hydrocarbon streams comprising, charging a liquid hydrocarbon stream which is not saturated with water less than 50 wt. ppm water and from 0.1 to 100 wt. ppm acidic halogen compounds to a neutralization reactor containing particles of solid caustic disposed within said reactor as a bed with a void volume of at least 10%, said caustic particles having a low surface area and being essentially non-porous; removing at least a majority of said acidic halides by reaction with said solid caustic to form salts, which are deposited on the surface of said solid caustic, and water of neutralization, which is essentially completely dissolved in said dry liquid hydrocarbon so that no aqueous phase forms in said treating vessel or in said bed; and removing from said bed and from said vessel a treated liquid hydrocarbon stream having a reduced content of acidic halides and being essentially free of any aqueous phase as a product of the process.

In another embodiment, the present invention provides a process for producing a chloride free reformate comprising distilling a hydrocarbon fraction to produce a naphtha boiling range fraction which has been distillation dried, hydrotreating in a hydrotreating means said naphtha fraction to produce a hydrotreated naphtha, and distilling said hydrotreated naphtha to remove a light fraction comprising reaction products of hydrotreating and to distillation dry said hydrotreated naphtha to produce a dry, hydrotreated naphtha fraction; reforming said dry hydrotreated naphtha in a platinum reforming reactor containing chloride containing reforming catalyst and operating at reforming conditions to produce a chloride containing reformer reactor effluent; separating said reformer reactor effluent in a vapor liquid separator operating at vapor liquid separation conditions said reformer reactor effluent into a vapor phase rich in hydrogen and a liquid reformate phase containing from 0.5 to 20 wt. ppm chlorides and less than 100 wt. ppm water; charging said liquid reformate phase to a neutralization reactor containing particles of solid caustic disposed within said reactor as a bed with a void volume of at least 20%, said caustic particles having a surface area of less than about 1 m 2/g and being essentially non-porous; removing at least a majority of said chlorides in said reformate by reaction with said solid caustic to form chloride salts, which are deposited on the surface of said solid caustic, neutralized reformate with a reduced chloride content, and water of neutralization, which is essentially completely dissolved in said neutralized reformate so that no aqueous phase forms in said treating vessel or in said bed and removing from said treating vessel a reduced chloride reformate stream which is essentially free of any aqueous phase as a product of the process.

In yet another embodiment, the present invention provides a process for producing a chloride free reformate and salt crystals comprising distilling a hydrocarbon fraction to produce a naphtha boiling range fraction which has been distillation dried, hydrotreating in a hydrotreating means said naphtha fraction to produce a hydrotreated naphtha, and distilling said hydrotreated naphtha to remove a light fraction comprising reaction products of hydrotreating and to distillation dry said hydrotreated naphtha to produce a dry, hydrotreated naphtha fraction, reforming said dry hydrotreated naphtha in a platinum reforming reactor containing chloride containing reforming catalyst and operating at reforming conditions to produce a chloride containing reformer reactor effluent, separating said reformer reactor effluent in a vapor liquid separator operating at vapor liquid separation conditions said reformer reactor effluent into a vapor phase rich in hydrogen and a liquid reformate phase containing from 0.5 to 20 wt. ppm chlorides and less than 100 wt. ppm water, charging said liquid reformate phase to a neutralization reactor containing substantially uniform pellets or spheres of solid caustic disposed within said reactor as a bed with a void volume of at least 25%, said caustic particles having a surface area of less than about 1 m 2/g and being essentially non-porous, and wherein said solid caustic bed is a fixed or fluidized bed of solid caustic on a screen or a porous support, and there is upflow of liquid reformate through said bed, removing at least a majority of said chlorides in said reformate by reaction with said solid caustic to form chloride salts, which are deposited on the surface of said solid caustic or as small salt crystals which fall down through said bed and through said porous support or screen, neutralized reformate with a reduced chloride content, and water of neutralization, which is essentially completely dissolved in said neutralized reformate so that no aqueous phase forms in said treating vessel or in said bed, removing from said treating vessel a reduced chloride reformate stream which is essentially free of any aqueous phase as a product of the process.

BRIEF DESCRIPTION OF THE DRAWINGS

The Figure is a simplified schematic view of a preferred solid caustic reactor for treating a liquid reformate stream.

DETAILED DESCRIPTION OF PREFERRED EMBODIMENTS

The invention can be better understood in conjunction with a review of the Figure.

The Pt reformer is shown largely as a box 10, to which feed in line 2 and recycle hydrogen in line 26 are added and from which reactor effluent is removed via line 12. Not shown are heaters, pumps, valves and much other process equipment. Chlorine or compounds thereof will usually be injected either with the feed, or added directly or indirectly via catalyst regeneration. The reactor effluent vapor, after heat exchange with feed and cooling by means not shown, is charged via line 12 to vapor liquid separator 20. A recycle hydrogen stream is withdrawn from the separator via line 22 and recycled via line 26 to reactor 10. The net gas make is withdrawn via line 28. These parts of the reformer are conventional and form no part of the present invention.

Reformate liquid is withdrawn from the separator via line 24 and charged to solid caustic treater 30, shown partially in cross section. Basically the treater is a large fixed bed containing solid caustic. The caustic solids can be mixed with, or held by, solid supports such as activated carbon, woods, fibers, etc, or solid caustic pellets may be supported by a screen or grid 45 in the base of the treater.

Reformate is added to the top of the treater, passes down through bed 40, through screen 45 and is withdrawn via line 32 for further processing in means not shown, such as a conventional debutanizer. Reformate can also flow up through the bed.

A boot 35 in the base of treater 30 permits removal of any aqueous phase which may be present. It is primarily an aid to periodic rejuvenation of the surface of the non-porous solid caustic.

The treater may be periodically removed from service or bypassed, for bed rejuvenation. For this, some reformate, or even fresh feed or other hydrocarbon liquid, is circulated in a loop from treater 30 to salt extractor 50 as discussed hereafter. A liquid hydrocarbon stream saturated with water and perhaps containing a minor amount of entrained water is charged via line 52 into the top of treater 40. The hydrocarbon continuous phase passes through the bed of solid caustic, and the water in the hydrocarbon selectively dissolves the soft salt deposits on the surface of the solid caustic pellets to form brine. A brine phase forms in boot 35 in the base of treater 30, with reformate or hydrocarbon charged via line 32 to downstream processing. In this type of operation the brine is simply removed via lines 37, 42 and 43 and discarded.

Preferably, the entire hydrocarbon stream passing through the caustic bed is withdrawn via lines 37 and 39 and charged to solvent saturator and salt extractor 50. Water may be maintained in this vessel in the lower portion of a packed bed 56, with a water/hydrocarbon interface 55. Passage of the hydrocarbon phase through the water removes salt from the hydrocarbon, and saturates the hydrocarbon for reuse via line 52. A brine phase may be withdrawn via line 54 and sent via line 43 to the refinery waste treatment facility.

More details will now be provided about each part of the process.

Catalytic Reforming

This process is well known and widely used, most refineries have catalytic reforming units. Essentially all catalytic reformers operate with chlorine addition, either to the catalyst prior to startup, to the feed during normal operation, or as part of a continuous catalyst regeneration unit associated with a moving bed reformer.

Reformers are available from several licensors. UOP Inc, Des Plaines, Ill. will provide both fixed and moving bed reforming units.

Conventional reforming conditions can be used, including a temperature of 850°to 1050° F., a pressure of atmospheric to 500 psig and a LHSV of 0.1 to 10 Hr-1. Most reformers operate with recycle hydrogen, with from a 1:1 to 10:1 H2:hydrocarbon mole ratio.

Chloride In Reformate

Moving bed units frequently produce reformate with more than 0.5 wt ppm Cl, and often in excess of 1 wt. ppm Cl, and sometimes with 2 or 3+wt. ppm Cl. Fixed bed units operating with large amounts of Cl addition due to catalyst demands or imminent shutdown for regeneration can produce reformate with like amounts of Cl, though typically moving bed units have the highest Cl levels.

Chloride levels may be continuously, or intermittently, troublesome. Chloride in reformate will usually be highest just before regeneration (for fixed bed units) or just before replacement of catalyst (in the case of moving bed units).

Some refiners may use other halogens such as F in full or partial replacement of Cl. My process will efficiently capture these materials as well, but KOH should be used rather than NaOH to react with flourides.

Solid Caustic Treating

My process is very simple. Reformate contacts solid caustic. No aqueous phase is present nor are any other chemicals added except for the initial load of solid caustic.

Even the chemistry of my process is simple. Simple neutralization reactions are involved which proceed rapidly. the primary reactions involved are:

$$HCl+NaOH \rightarrow NaCl+H_2O$$

$$NH_4Cl+NaOH \rightarrow NH_3+NaCl+H_2O$$

$$FeCl_3+NaOH \rightarrow Fe(OH)_3+{}_3NaCl+{}_3H_2O$$

The reaction products are water and salt. The water is present in such small amounts that it remains dissolved in the naphtha which is charged to the debutanizer. The salt deposits on the solid caustic particles.

The solid caustic is preferably in the form of pure particles of a suitable caustic material, such as NaOH, KOH, CaO, MgO and the like. This material may be extruded, pilled, prilled, or formed using conventional techniques into any desired shape, preferably one with a high surface area to volume ratio which is mechanically strong and allows free flow of liquids.

To improve material handling it may be beneficial to add conventional solid supports to or around the solid caustic. Thus the caustic solids can be mixed with activated carbon, porous resins, woods, fibers and the like. When a support is used it preferably comprises a minority of the reactive solid, so that a majority, by weight, of the reactive solid used in the bed is caustic.

Alternatively the solid caustic may be in baskets or fiber bags, perforated tubes, trays or the like.

For a long bed life, the solid caustic used should be non-porous and have a relatively low surface area. If, e.g., ground caustic (a mix of small and larger particles) is used in a fixed, dry bed, the bed may plug with salt crystals in either up or down flow operation. Such a bed, with little void volume, would be susceptible to fusing should some process upset occur which adds even small amounts of water, and causes formation of an aqueous phase on the bed of caustic.

Caustic beads or other mechanically strong form of solid caustic with a shape leading to a large void volume in the reactor may safely be used for dry bed operation.

While use of pure NaOH pellets—technical grade rather than reagent grade—is preferred for low cost, porosity and surface area, other materials such as glassmakers alkali (a mixture of about 20% $Ca(OH)_2$+80% NaOH), or KOH, soda lime, and like materials may also be used, though not necessarily with equivalent results.

At least a majority, and preferably at least 80%, and more preferably at least 90%, of the alkaline solid is NaOH or KOH.

The solid caustic can be used in the form of a high surface area material such as berl saddles, multi-lobed pellets, or the like. It is preferred to use a type of solid caustic which is non-porous, and has a large void volume. Non-porous caustics are less likely to crumble or collapse than porous materials. It also makes efficient regeneration possible. A large void volume will reduce the pressure drop associated with gas flow through the bed, and provide space for salt crystals to form and accumulate.

Expressed in terms of % interstitial volume, the bed should have at least 10% interstitial volume. If a 1 m cubic box of solid caustic could contain less than 0.1 cubic meters of mercury, the interstitial volume is too low.

Interstitial volumes of 10 to 50% will give good results, and preferably interstitial volumes are 12.5 to 40%, and most preferably are about 25 to 35%.

The solid caustics used preferably are relatively non-porous. One way to measure porosity is in terms of total surface area of the caustic, a measure of the external surface area of each particle or pellet and the internal surface area due to porous structure. The solid caustics used should have a total surface area of less than 1 m2/g, and preferably less than 0.5, and most preferably less than 0.1 m2/g.

The inexpensive, technical grade bead caustics commonly available have good properties for use herein. They have the shape of fairly uniform spheres and have an interstitial volume around 30–35%, and a low surface area. I have not measured the surface area, but estimate it at less than 0.1 m2/g.

I have tested these bead materials, and they work well. Crushed caustics—which have a much higher surface area—are not suitable, as the bed plugs rapidly from salt.

Reaction Conditions

The reaction of halogen species, usually chlorides, with solid alkaline materials proceeds rapidly. It is somewhat surprising to me that the reaction proceeds so rapidly, in that there is no water phase present at any time during normal operation of this process.

Chlorides are corrosive when water is present, but known not to be corrosive in such dry streams. It is strange that these streams are dry enough to keep chlorides from reacting with steel (i.e., being corrosive) while allowing the chlorides to react with solid, beads of caustic having a low surface area.

In functional terms, contact of liquid reformate with the solid caustic bed should be long enough to remove at least a majority, and preferably more than 90%, and most preferably more than 99% of the chlorides in the reformate. Short contact times reduce the size of the equipment, but may not permit long enough operation to react the chlorides with the caustic to the extent desired.

In terms of space velocity, the LHSV may range from 0.1 to 100, and preferably from 1 to 30 LHSV.

Temperatures and pressures used are not narrowly critical. In general, the process works well at the conditions found downstream of the vapor/liquid separator of the reformer. Pressures should be high enough to maintain liquid phase operation, and temperatures may range from 5°to 100° C. or higher, with temperatures of 10°–50° C. giving good results.

Caustic is used stoichiometrically, not catalytically. Caustic is continuously consumed and the solid bed will eventually need to be replenished or replaced. Although the process does not use a "catalyst" per se, and the bed consumes itself for treating, the process operates a long time because the caustic is present as a high caustic content solid rather than a dilute liquid. The solid caustic bed will react with chlorides until salt buildup causes a breakthrough in Cl levels or an unacceptable increase in pressure drop getting across the bed. At this point the process may be shut down briefly for caustic surface rejuvenation, and/or so that additional solid caustic can be added.

Alternatives for continuous operation include a swing reactor system, or a continuous addition systems with lock hoppers above and below the solid caustic bed, which can be used to replace salt coated solid caustic without stopping the flow of reformate.

Reactor Design

One of the most important features of the present invention is that is permits a relatively low tech reactor to do some surprising chemistry (dry acid/base reactions) with cheap reagents. Refiners are very comfortable using simple, upflow and downflow fixed bed reactors.

When a simple fixed bed reactor is used, with the solid caustic simply dumped onto a screen or dumped structured packing, the following guidelines can be given. The reactor preferably contains structured packing (~1–50% of reactor volume) in a lower portion of the reactor and then solid caustic (over 50% or reactor volume, and preferably 80–95% of reactor volume). Some of the volume of the reactor at the top can be empty, say 0–20% or less than 5%. The reactor can be very simple.

Either upflow, downflow or cross-flow operation is possible. Downflow operation will be preferred by many refiners, as such a bed will not be fluidized by any sudden changes in flow rates.

Cross-flow, especially if practiced in a radial flow reactor, greatly increases the cross sectional surface of the solid bed of caustic presented to reformate liquid.

Most refiners will prefer to use a simple fixed bed system. The process provides satisfactory run lengths, despite using a bed which is consumed during the halogen removal process.

Long runs are achieved when treating, e.g., a reformate because the bed contains solid caustic, rather than a dilute solution of caustic, and the flowing reformate fed to the reactor usually contains less than about 1 wt ppm Cl. For such feeds, operating cycles of 1 to 100 months can be obtained depending on the flow rate and the size of the caustic bed.

EXAMPLES

Feed

A composite of products from a continuous catalytic reformer (CCR) pilot plant was used as the base feed. The typical reforming severity was 101 RON/91.6 MON for the $C_6$+ product. The moisture content was determined to be 7 ppm, while chloride was determined using a chloride electrode to be 0.23 ppm. For testing in the process, the base feed was doped with 10 ppm of $Cl^-$ from HCl, 10 ppm of $Cl^-$ from $NH_4Cl$ and 0.1 ppm $Cl^-$ from $FeCl_3$. In doping the feed with chlorides, the moisture content of the feed was increased from 7 to 10 ppm.

Reactor

The reactor is a ⅜" stainless steel tube fitted with a check valve and TEE. Right above the tee, the tube was packed with 1 cc of stainless steel cannon packings, and then 5 cc of NaOH beads. The tube above the solid caustic bed is empty. The reactor temperature was controlled by use of a heat tape.

Operating Procedure

The reactor was filled with the solid caustic before startup. The feed was pumped up through the bed at 20 cc/hr., 80° F. at about 50 psi. The chlorides react with the solid caustic and salt is observed to deposit as soft, fluffy deposits on the solid caustic. Finally, the reformate product was recovered for analyses.

In this particular example, there was a fairly high water content in the feed, enough that a separate brine phase formed which coated the solid caustic and dissolved the salt.

The present invention is directed only to the completely non-aqueous phase operation, where the salt deposits in the form of soft deposits.

Analysis

1. Chloride:

The product was extracted with 1/10 th volume of water using an efficient plunger type mixer. The water phase was analyzed for chloride using a chloride electrode (Model 94-17B by Orion). The samples were also sent to our analytical lab for confirmation purposes.

2. Moisture:

The moisture contents were analyzed using Parametric (Model 2000) analyzer. Unfortunately, the Karl-Fisher titrator was not sensitive enough for feeds with such a low moisture content. Samples were also sent to our analytical lab to test for moisture for confirmation.

The experimental results are presented in the Table.

Table of Experimental Results

Temp. °F.: 80
Pressure, psig: 50
Solid Caustic cc: 5
Feed Rate, cc/hr.: 20
Feed: Doped with chlorides

DISCUSSION

1. Efficacy of the Process

The process is effective in removing chlorides from reformate using a completely dry bed of solid caustic pellets The efficacy of the process is believed due to the high rate of the neutralization reaction. The reactions are simple neutralizations with rates too fast to measure. The efficacy of the process is assured by providing intimate contact between the oil droplets and solid caustic in the bed. The solid caustic remained dry throughout the neutralization reaction, with the salt formed ending up as soft deposits of salt crystals on the caustic. The water formed in the neutralization is safely carried away by the dry reformate, which is far from saturated with water.

2. Moisture Content of Product:

The product will be very dry. The only water added during normal operation would be water of hydration. If large amounts of chlorides or other acidic species are present in the feed, it is possible to perhaps generate enough water of hydration to cause some water to drop out of solution, and cause the bed to fuse. It is possible to run with an aqueous phase covering particles of solid caustic, but this requires careful control of operating conditions, as disclosed in my copending application directed to that multiphase mode of operation.

For the practice of the present invention, simplicity and reliability are of paramount importance, and the process should be operated so that no aqueous phase forms.

3. NaOH in Reformate

The NaOH carry over in the reformate product appears to be very low. If run properly, no aqueous phase will ever form, so there will be no brine. Salt will form, but deposits directly on the solid caustic in the treating vessel and should not contaminate the product.

The specification of alkalinity content in the finished gasoline is 0.5 ppm. This specification can be easily met by the process of the present invention.

Another application of my process to reformate treating is use of solid, low surface area caustic pellets, of uniform size, to form a bed with a large void volume. Such a bed can be used to treat reformate, and give the salt crystals formed some place to accumulate. In some types of operation, it is possible to have just enough water in the reformate stream to cause salt crystals to form, and fall off. This phenomenon was observed when passing a chloride containing gas over a reformate covered bed of solid caustic. The chloride passed through the reformate to react with the solid caustic and form small salt crystals which settled to the bottom of the reactor for disposal. The agitation provided by the gas may have helped dislodge the salt crystals. The gas contained a small amount of water, but not enough water in this particular test to cause formation of a separate brine phase.

The reasons for the salt crystals falling off and collecting in the bottom of the bed, without plugging the bed, are not fully understood.

APPLICABILITY TO OTHER PROCESSES

My process may also be used to remove chlorides or other halogens from isomerate from an isomerization unit using a catalyst on a halogen containing support, or using a halogen containing catalyst or other similar dry streams, with relatively low acidic halogen contents.

I prefer to charge to my process streams which boil in the naphtha range and are fairly clean streams. The streams must be dry, i.e., not saturated with water, and preferably contain less than ½ of the amount of water that could dissolve in the stream.

Similarly the stream to be treated should not contain water and potential water which would ever produce an aqueous phase at the treating conditions used. Water precursors, potential sources of water such as water of neutralization, could combine with native water in the stream treated to produce enough water to generate a water phase. Such operation is outside the scope of the present invention. As examples of streams which can not be treated in my totally dry process are crude products of alkylation which are saturated with water and which contain more than 100 ppm acidic species. These streams will convert even my relatively open bed of caustic particles into a fused mass which does not remove acids. The main product of such an operation is a large, fused bed of solid caustic which can not be easily removed from the treating vessel.

WATER CONTROL

All reformates will generally have sufficiently low water levels to permit them to be treated in my dry bed process. Other streams may be treated if they are dried sufficiently so that no water phase forms in the solid caustic bed, perhaps by distillation or some other drying method such as molecular sieve driers. In general, the extra treating steps will be too costly, or an additional place where corrosion may occur or deposits may form, so most refiners will prefer to use my process only for streams which are inherently "dry" and have no more than moderate amounts of acidic components.

I claim:

1. A process for removing acidic halides from dry liquid hydrocarbon streams comprising:

a. charging a liquid hydrocarbon stream which is not saturated with water less than 50 wt. ppm water and from 0.1 to 100 wt. ppm acidic halogen compounds to a neutralization reactor containing particles consisting essentially of solid caustic disposed within said reactor as a bed with a void volume of at least 10%, said caustic particles having a low surface area and being essentially non-porous;

b. removing at least a majority of said acidic halides by reaction with said solid caustic to form:

salts, which are deposited on the surface of said solid caustic, and water of neutralization, which is essentially completely dissolved in said dry liquid hydrocarbon so that no aqueous phase forms in said treating vessel or in said bed;

c. removing from said bed and from said vessel a treated liquid hydrocarbon stream having a reduced content of acidic halides and being essentially free of any aqueous phase as a product of the process.

2. The process of claim 1 wherein the halogen is chlorine.

3. The process of claim 1 wherein the liquid hydrocarbon stream is a reformate containing 0.5 to 50 wt. ppm chloride as HCl, $NH_4Cl$, $FeCl_3$ and mixtures thereof, and less than 50 wt. ppm water, and wherein more than 90% of said chloride is removed.

4. The process of claim 1 wherein said solid caustic is beads or pellets of NaOH, KOH or mixtures thereof.

5. The process of claim 1 wherein said solid caustic is essentially pure NaOH or KOH.

6. The process of claim 1 wherein said salt deposits are intermittently removed by washing said bed with a wash liquid hydrocarbon stream which is saturated with water.

7. The process of claim 1 wherein said liquid hydrocarbon is a reformate with 1 to 10 wt. ppm chlorides and less than 20 wt. ppm water.

8. A process for producing a chloride free reformate comprising;

a) distilling a hydrocarbon fraction to produce a naphtha boiling range fraction which has been distillation dried, b) hydrotreating in a hydrotreating means said naphtha fraction to produce a hydrotreated naphtha, and distilling said hydrotreated naphtha to remove a light fraction comprising reaction products of hydrotreating and to distillation dry said hydrotreated naphtha to produce a dry, hydrotreated naphtha fraction;

c) reforming said dry hydrotreated naphtha in a platinum reforming reactor containing chloride containing reforming catalyst and operating at reforming conditions to produce a chloride containing reformer reactor effluent;

d) separating said reformer reactor effluent in a vapor liquid separator operating at vapor liquid separation conditions said reformer reactor effluent into a vapor phase rich in hydrogen and a liquid reformate phase containing from 0.5 to 20 wt. ppm chlorides and less than 100 wt. ppm water;

e) charging said liquid reformate phase to a neutralization reactor containing particles consisting essentially of solid caustic disposed within said reactor as a bed with a void volume of at least 20%, said caustic particles having a surface area of less than about 1 m2/g and being essentially non-porous;

f. removing at least a majority of said chlorides in said reformate by reaction with said solid caustic to form:

chloride salts, which are deposited on the surface of said solid caustic, neutralized reformate with a reduced chloride content, and water of neutralization, which is essentially completely dissolved in said neutralized reformate so that no aqueous phase forms in said treating vessel or in said bed;

g. removing from said treating vessel a reduced chloride reformate stream which is essentially free of any aqueous phase as a product of the process.

9. The process of claim 8 wherein said solid caustic is beads or pellets of NaOH, KOH or mixtures thereof.

10. The process of claim 8 wherein said caustic is NaOH.

11. The process of claim 8 wherein said salt deposits are intermittently removed by washing said bed with reformate or hydrotreated naphtha which is saturated with water.

12. The process of claim 8 wherein said reformate has 1 to 10 wt. ppm chlorides and less than 20 wt. ppm water.

13. A process for producing a chloride free reformate and salt crystals comprising;

a) distilling a hydrocarbon fraction to produce a naphtha boiling range fraction which has been distillation dried, b) hydrotreating in a hydrotreating means said naphtha fraction to produce a hydrotreated naphtha, and distilling said hydrotreated naphtha to remove a light fraction comprising reaction products of hydrotreating and to distillation dry said hydrotreated naphtha to produce a dry, hydrotreated naphtha fraction;

c) reforming said dry hydrotreated naphtha in a platinum reforming reactor containing chloride containing reforming catalyst and operating at reforming conditions to produce a chloride containing reformer reactor effluent;

d) separating said reformer reactor effluent in a vapor liquid separator operating at vapor liquid separation conditions said reformer reactor effluent into a vapor phase rich in hydrogen and a liquid reformate phase containing from 0.5 to 20 wt. ppm chlorides and less than 100 wt. ppm water;

e) charging said liquid reformate phase to a neutralization reactor containing substantially uniform pellets or spheres consisting essentially of solid caustic disposed within said reactor as a bed with a void volume of at least 25%, said caustic particles having a surface area of less than about 1 m2/g and being essentially non-porous, and wherein:

said solid caustic bed is a fixed or fluidized bed of solid caustic on a screen or a porous support, and there is upflow of liquid reformate through said bed;

f. removing at least a majority of said chlorides in said reformate by reaction with said solid caustic to form:

chloride salts, which are deposited on the surface of said solid caustic or as small salt crystals which fall down through said bed and through said porous support or screen, neutralized reformate with a reduced chloride content, and water of neutralization, which is essentially completely dissolved in said neutralized reformate so that no aqueous phase forms in said treating vessel or in said bed;

g. removing from said treating vessel a reduced chloride reformate stream which is essentially free of any aqueous phase as a product of the process.

14. The process of claim 13 wherein there is at least periodic agitation of said bed of solid caustic.

15. The process of claim 14 wherein a gas stream is charged to a lower portion of said bed or mixed with liquid reformate feed to said bed.

16. The process according to claim 1 wherein said hydrocarbon stream is charged to said reactor at a temperature between 5° C. and 100° C.

17. The process according to claim 8 wherein said liquid reformate is charged to said reactor at a temperature between 5° C. and 100° C.

18. The process according to claim 13 wherein said liquid reformate is charged to said reactor at a temperature between 5° C. and 100° C.

* * * * *